US006418568B1

(12) United States Patent
Briggs et al.

(10) Patent No.: US 6,418,568 B1
(45) Date of Patent: Jul. 16, 2002

(54) EVERSIBLE STOPPER/STRAINER DEVICE

(76) Inventors: Raymond Briggs, 15 Recreation Road, Hamilton Hill, Western Australia, 6163; Bernard Lindsay Newman, 7 Eel Place, Cooloongup, Western Australia, 6168; Mark Alwyn Luff, 109 The Esplanade, Rockingham, Western Australia, 6168, all of (AU)

( * ) Notice: Subject to any disclaimer, the term of this patent is extended or adjusted under 35 U.S.C. 154(b) by 0 days.

(21) Appl. No.: 09/367,883

(22) PCT Filed: Feb. 18, 1998

(86) PCT No.: PCT/AU98/00096

§ 371 (c)(1),
(2), (4) Date: Aug. 19, 1999

(87) PCT Pub. No.: WO98/37281

PCT Pub. Date: Aug. 27, 1998

(30) Foreign Application Priority Data

Feb. 19, 1997 (AU) ..... PO5155

(51) Int. Cl.[7] ..... E03C 1/26
(52) U.S. Cl. ..... 4/287; 4/292
(58) Field of Search ..... 4/287, 292, 293

(56) References Cited

U.S. PATENT DOCUMENTS 1,581,533 A * 4/1926 Freer ..... 4/287
2,643,394 A * 6/1953 Wood ..... 4/287

FOREIGN PATENT DOCUMENTS

| | | |
|---|---|---|
| CH | 506663 | 6/1971 |
| FR | 1430191 | 1/1966 |

* cited by examiner

*Primary Examiner*—Robert M. Fetsuga
(74) *Attorney, Agent, or Firm*—Marger Johnson & McCollom, PC

(57) ABSTRACT

A stopper-strainer device (1) having a diaphragm (2) and a closure plate (4). The diaphragm (2) is provided with apertures (6) for passage of fluid. The diaphragm (2) is movable between 2 first and second conditions in which the stopper-strainer device (1) functions as a stopper and a strainer, respectively. In the first condition, the closure plate (4) seals with the diaphragm (2) so that the stopper-strainer device (1) functions as a stopper to prevent fluid flow. In the second condition, the closure plate (4) is spaced from the diaphragm (2) and fluid is able to pass through the apertures (6) so that the stopper-strainer device (1) functions as a strainer to allow fluid flow while restraining material entrained in the fluid that is unable to pass through the apertures (6).

16 Claims, 4 Drawing Sheets

EVERSIBLE STOPPER/STRAINER DEVICE

TECHNICAL FIELD

The present invention relates to a stopper-strainer device. Such a stopper-strainer device may operate to stop fluid flow or to allow fluid flow whilst straining or filtering the fluid flowing therethrough. Such a stopper-strainer device may be used in sinks and basins in commercial, industrial and domestic environments.

BACKGROUND ART

Stopper-strainer devices have been developed in order to combine the functions of a stopper and strainer into a single device. Such stopper-strainer devices are generally provided with apertures to strain particulate material entrained in the fluid passing through the stopper-strainer device, but it is necessary to remove the stained, or filtered, particulate material from the stopper-strainer device after use. Generally, removal of the particulate material from the stopper-strainer device is achieved by scrapping, knocking, or flushing the strained particulate material from the stopper-strainer device. However, this task is generally considered to be messy and sometimes distasteful, and is often awkward and time consuming.

DISCLOSURE OF INVENTION

In accordance with one aspect of the present invention, there is provided a stopper-strainer device comprising diaphragm means and closure means, said diaphragm means having apertures for passage of fluid and said diaphragm means is movable between first and second conditions, wherein in said first condition fluid is unable to flow beyond said closure means such that, in use, said stopper-strainer device prevents fluid flow, and in said second condition said closure means is spaced from said diaphragm means and, in use, fluid is able to pass through said apertures, such that said stopper-strainer device allows fluid flow while restraining material entrained in said fluid that is unable to pass through said apertures.

Preferably, said closure means is provided with at least one edge and said edge seals with said diaphragm means in said first condition.

Preferably, said closure means is resiliently biased toward said diaphragm means in said first condition.

Preferably, said stopper-strainer device has a first side and a second side, the surface of said stopper-strainer device at said second side being substantially smooth and continuous except for said apertures and, in use, said material is restrained on said second side.

Preferably, said diaphragm means is substantially resilient and flexible.

Preferably, locating means is provided to, in use, locate said stopper-strainer device over the cross-section of a pipe or an entry thereto.

Preferably, frame means is provided around said diaphragm means.

Preferably, said frame means and said diaphragm means are connected via connection means which allows said diaphragm means to move between said first and second conditions.

Preferably, stopper-strainer device according to claim 8, characterised in that said connection means is provided between said frame means and said diaphragm means and is thinner than said frame means and said diaphragm means.

In one form the closure means may comprise a plate retained with said diaphragm means by lug means.

Preferably, said lug means extends from said diaphragm means on a first side of said stopper-strainer device.

Preferably, said diaphragm means is provided with retaining means to retain said plate in sealing contact with said diaphragm means.

Preferably, said plate engages with said retaining means of said diaphragm means.

Preferably, the edge of said plate is bevelled to mate with the surface of said diaphragm means.

Preferably, said lug means spaces said plate from said diaphragm means in said second condition of said diaphragm means.

Preferably, said retaining means comprises a formation extending on a first side of said stopper-strainer device.

In an alternative form, said closure means comprises gate means cut from said diaphragm means to form said apertures.

Preferably, said gate means are attached to said diaphragm means.

Preferably, the edges of the gate means seal with said diaphragm means in said first condition and are spaced from said diaphragm means in said second condition.

Preferably, said material restrained by said stopper-strainer device is removable by moving said diaphragm means from said second condition to said first condition.

BRIEF DESCRIPTION OF THE DRAWINGS

The present invention will now be described, by way of example, with reference to the accompanying drawings, in which:

FIG. 5*a* is an enlarged view of a cross-section of a portion of the stopper-strainer device taken along the line C—C shown in FIG. 5;

BEST MODE OF CARRYING OUT THE INVENTION

Figure 1:
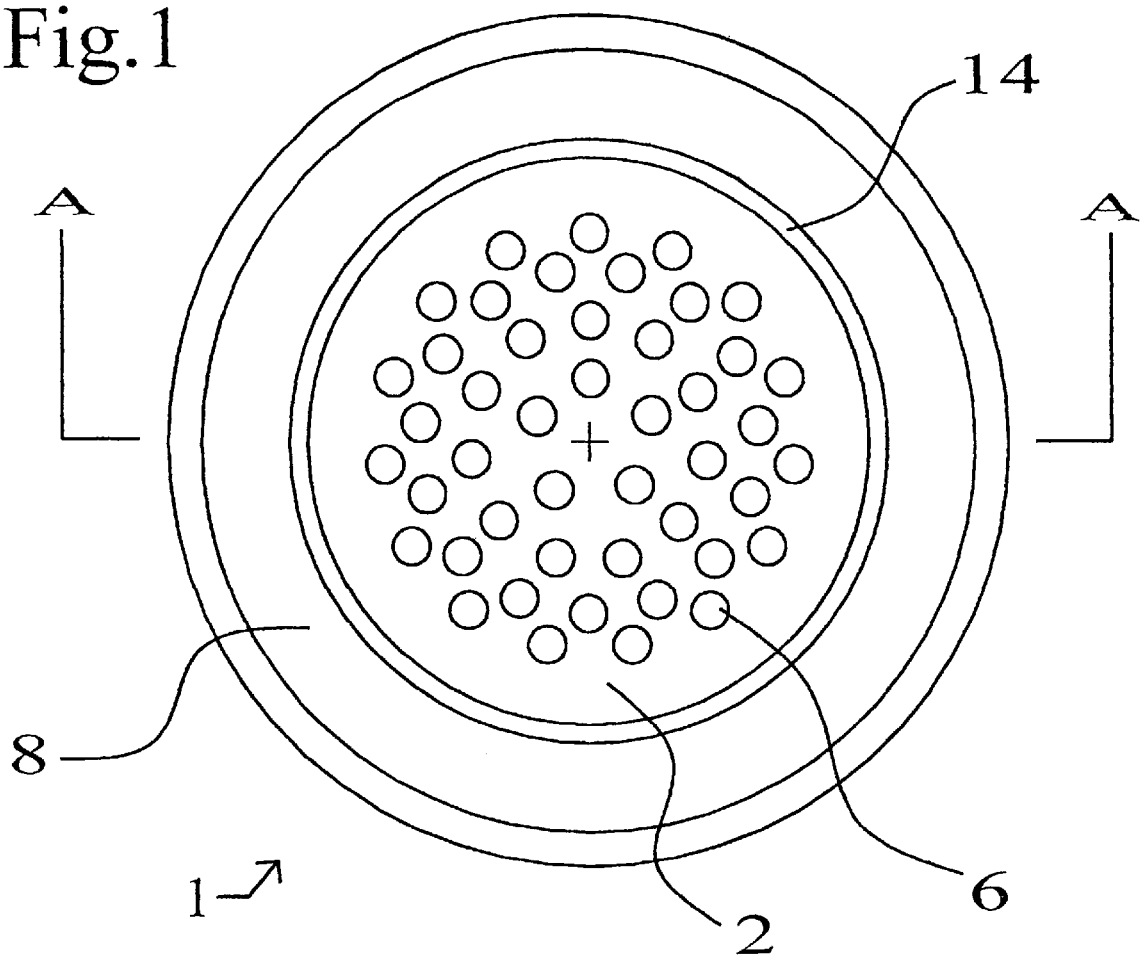
FIG. 1 is a top plan view of a first embodiment of a stopper-strainer device in accordance with an aspect of the present invention.

In FIGS. 1 to 4, there is shown a stopper-strainer device 1 comprising a diaphragm 2 and a closure plate 4. The diaphragm 2 is provided with apertures 6 therein. Fluid is able to pass through the apertures 6 whilst particulate material, entrained in fluid, that is unable to pass through the apertures 6 is restrained by the diaphragm 2.

The diaphragm 2 is connected to an outer frame or rim 8. The frame 8 enables the stopper-strainer device 1 to sit, in use, on the opening of a pipe or other suitable location of use of the stopper-strainer device 1. For example, in the case of the strainer-stopper device, in use, being used in a basin, sink or other vessel, the frame 8 is of an appropriate size to sit around the drain hole of the sink, basin, or other vessel with the diaphragm 2 covering the drain hole.

The stopper-strainer device 1 is provided with a locating member 10. The locating member 10 is arranged to locate within the opening of the pipe at which the stopper-strainer device 1 is used.

The locating member 10 is provided as a circular flange extending from the frame 8 on a first side 12 of the stopper-strainer device 1.

The diaphragm 2 is connected with the frame 8 by a connection portion 14. The connection portion 14 is provided around the periphery of the diaphragm 2 between the diaphragm 2 and the frame 8 such that the frame 8 is provided at the periphery of the diaphragm 2. The connection portion 14 is thinner than the frame 8 and the diaphragm 2.

The diaphragm 2 is substantially dome-shaped and is moveable between first and second conditions shown in FIGS. 2 and 4, respectively, as will be later herein described.

The diaphragm 2 is substantially resilient such that it is able to return to its dome-shape when it is moved between its first and second conditions.

The diaphragm 2 is substantially flexible which enables it to be moved between the first and second conditions.

The closure plate 4 is connected with the diaphragm 2 by a lug 16. The lug 16 extends from the diaphragm 2 on the side 12 of the stopper-strainer device 1. The closure plate 4 is provided on the first side 12 of the stopper-strainer device 1.

The diaphragm 2 is provided with a retaining member 18. The retaining member 18 is provided on the first side 12 of the stopper-strainer device 1.

The edge 20 of the closure plate 4 is bevelled.

Figure 2:
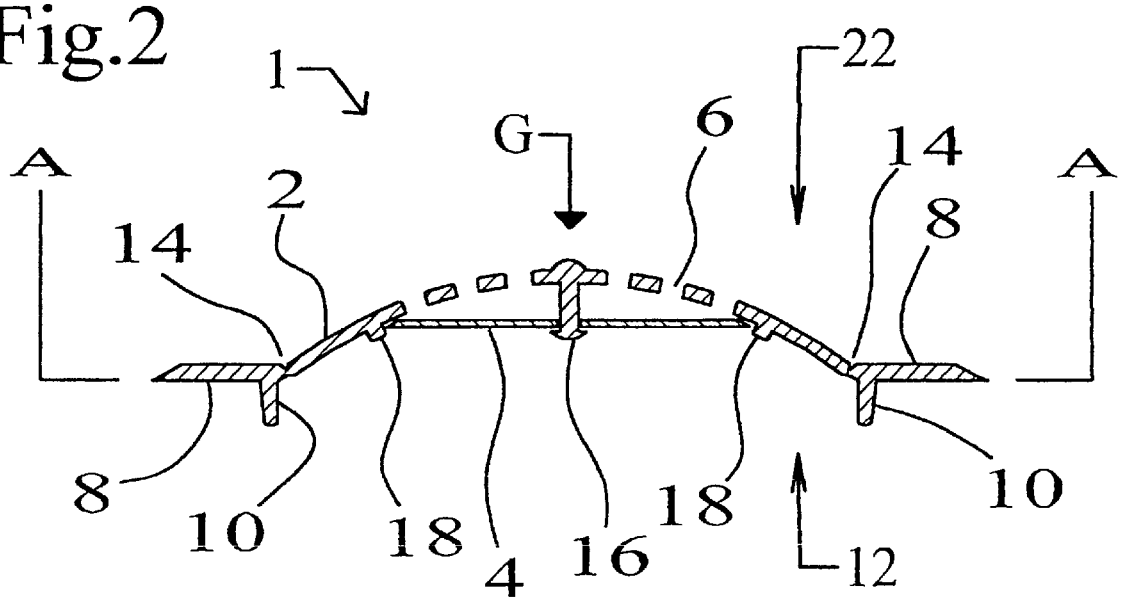
FIG. 2 is a cross-sectional view of the stopper-strainer device taken along the line A—A shown in FIG. 1.
Figure 3:
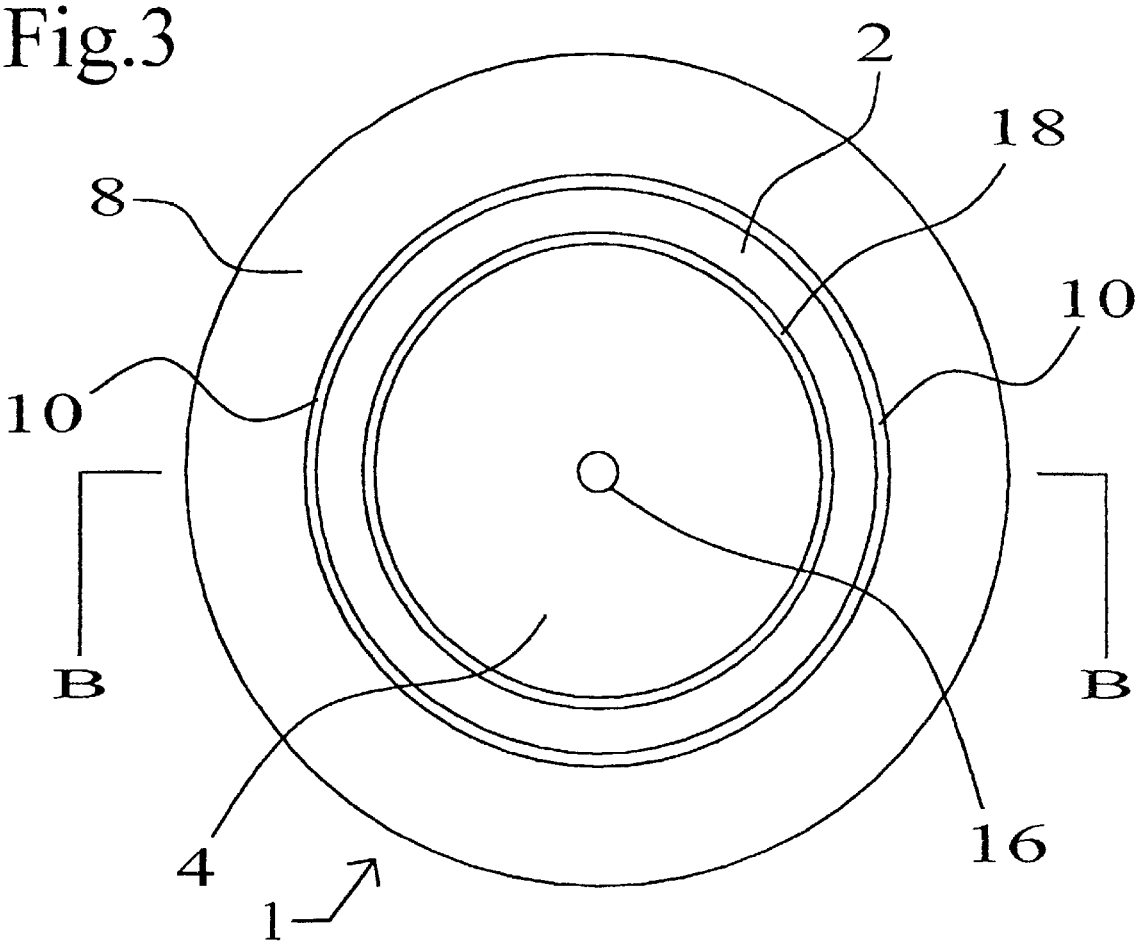
FIG. 3 is a bottom plan view of the stopper-strainer device shown in FIG. 1.
Figure 4:
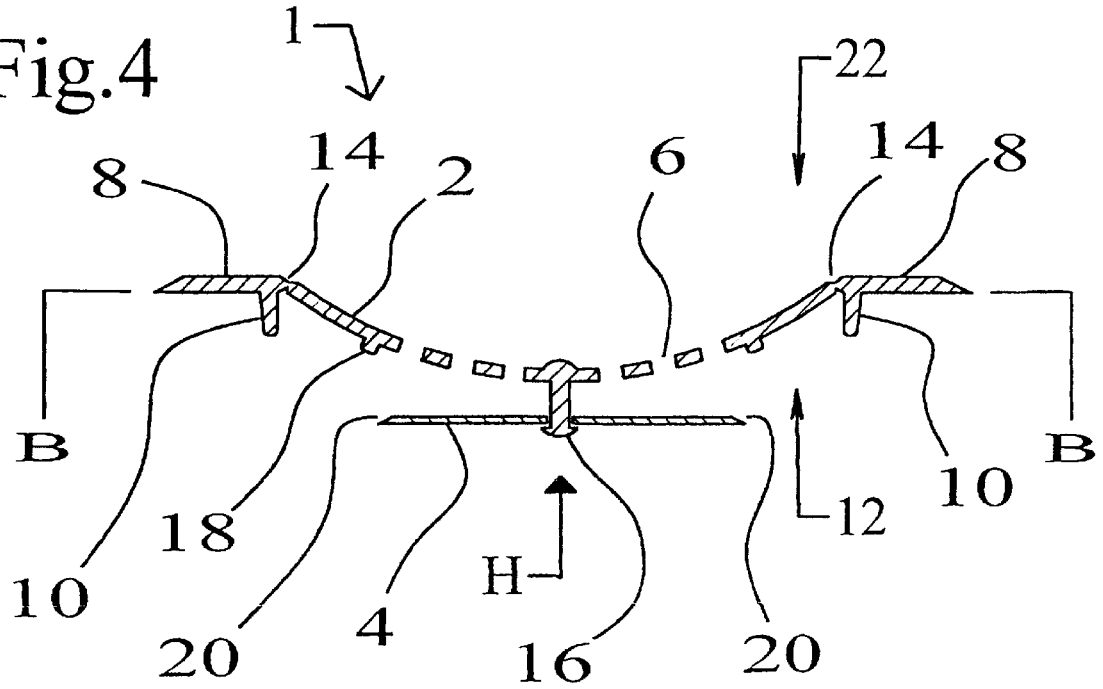
FIG. 4 is a cross-sectional view of the stopper-strainer device taken along the line B—B shown in FIG. 2.
Figure 5:
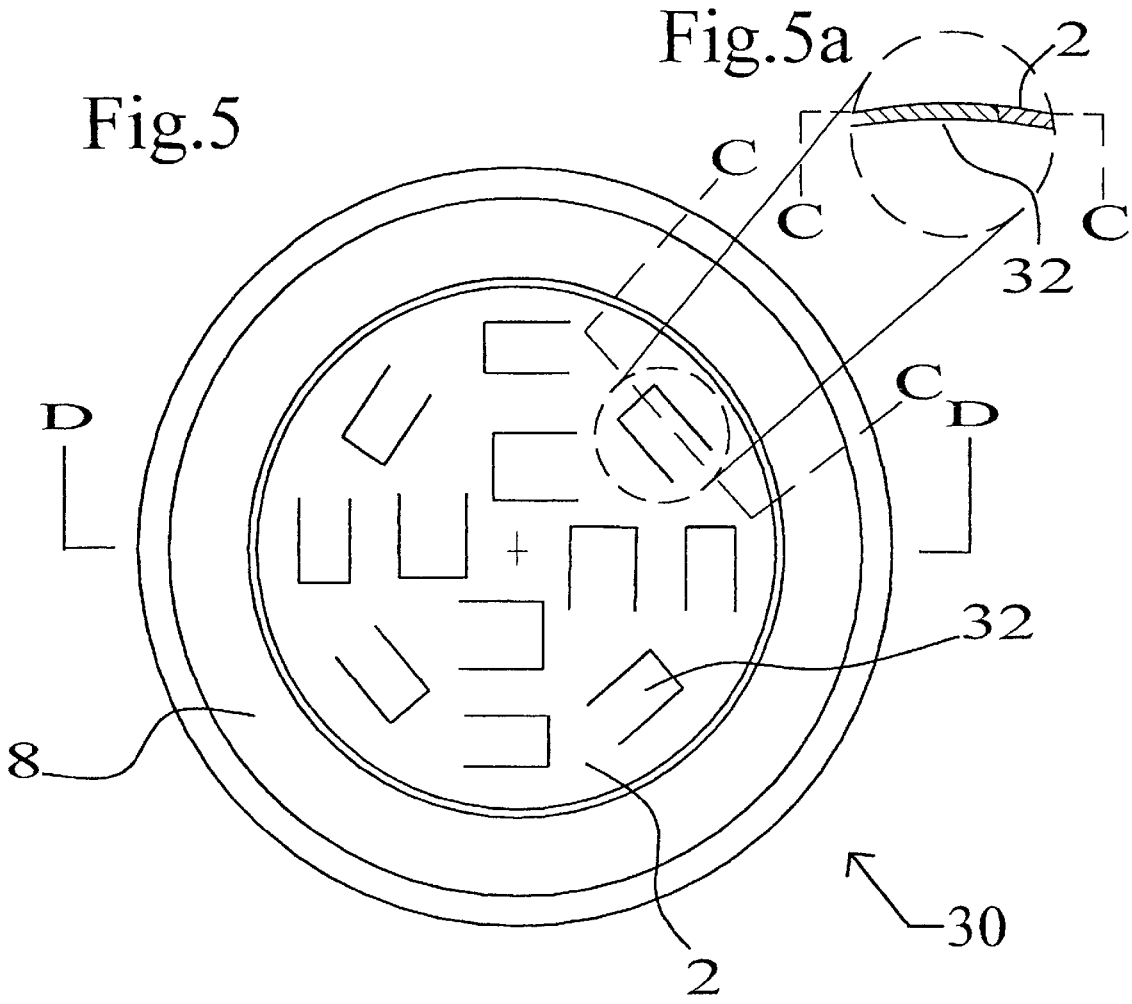
FIG. 5 is a top plan view of a second embodiment of a stopper-strainer device in accordance with an aspect of the present invention.

The diaphragm 2 is movable between first and second conditions shown in FIGS. 2 and 4, respectively, by pushing the diaphragm 2 so that it pivots via the connection portion 14. Accordingly, the diaphragm 2 may be pressed at its central region in the direction of arrow G, shown in FIG. 2, such that the diaphragm 2 pivots via the connection portion 14 and everts to its second condition shown in FIG. 4. Similarly, the diaphragm 2 may be pressed in the direction of arrow H in the region of the lug 16 such that the diaphragm 2 again pivots via the connection portion 14 and returns to its first condition shown in FIG. 2.

In the first condition, shown in FIG. 2, the closure plate 4 is resiliently biased toward the underside of the diaphragm 2. The bevel on the edge 20 of the closure plate 4 enhances contact with the diaphragm 2 since the bevel conforms with the curve of the diaphragm 2. This can be best seen in FIG. 2. In this way, a seal may be formed between the edge 20 of the closure plate 4 and the surface of the diaphragm 2. The edge 20 of the closure plate 4 engages with the retaining member 18 of the diaphragm 2. This retains the closure plate 4 in sealing contact with the diaphragm 2.

Accordingly, in the condition of the diaphragm 2 shown in FIG. 2, fluid on the second side 22 of the stopper-strainer device 1 is unable to flow beyond the closure plate 4 to the first side 12 of the stopper-strainer device 1 due to the seal formed by the edge 20 of the closure plate 4 and the diaphragm 2.

When the diaphragm 2 is pushed so that it is everted to its second condition, shown in FIG. 4, the edge 20 of the closure plate 4 is no longer in sealing contact with the diaphragm 2. This allows fluid to flow from the second side 22 of the stopper-strainer device 1 through the apertures 6 to the first side 12 of the stopper-strainer device 1. In this condition of the diaphragm 2, any particulate material entrained in the fluid that is unable to pass through the apertures 6 is restrained or trapped by the diaphragm 2 of the stopper-strainer device 1.

Once all of the fluid has passed from the second side 22 to the first side 12 of the stopper strainer device 1, any particulate material that has been restrained by the diaphragm 2 can be readily removed therefrom. This is done by pushing the diaphragm 2 from its second condition, shown in FIG. 4, to its first condition, shown in FIG. 2, over a bin or other receptacle. The diaphragm 2 should be pushed with sufficient force such that any particulate material restrained by the diaphragm 2 is expelled therefrom.

In the second condition of the diaphragm 2, in which the stopper-strainer device 1 functions as a strainer, the diaphragm 2 is concave, or bowl-shaped, so that particulate material can collect herein.

In the first condition of the diaphragm 2, in which the stopper-strainer device 1 functions as a stopper, the diaphragm 2 is convex shaped. Furthermore, the surface of the diaphragm 2 is continuous, apart from the aperture 6 therein, and does not have any projections or protuberances on the second side 22 of the stopper-strainer device 1.

In the first condition of the diaphragm 2, the diaphragm 2 projects beyond the frame 8 on the second side 22 of the stopper-strainer device 1. In the second condition of the diaphragm 2, the diaphragm 2 projects beyond the frame 8 on the first side 12 of the stopper-strainer device 1.

The provision of the locating member 10, retaining member 18, lugs 16 and the closure plate 4 on the second side 12 of the stopper-strainer device 1 also means that the expulsion of the particulate material from the diaphragm 2 is more effective. This is because the particulate material collects on the surface of the diaphragm 2 on the side 22 of the stopper-strainer device 1. When the diaphragm 2 is everted to expel particulate material therefrom, the diaphragm 2 is everted to its first condition and since there are no protuberances or projections on the second side 22 of the stopper-strainer device 1, the particulate material does not contact or lodge on any other part of the stopper-strainer device 1 but, instead, is expelled from the diaphragm 2 without contacting other parts of the stopper-strainer device 1.

In use, the stopper-strainer device 1 may function as a stopper when the diaphragm 2 is in its first condition in which the closure plate 4 seals with the diaphragm 2 to prevent fluid flow. With the diaphragm 2 in this condition, the stopper-strainer device 1 may be placed at the drain outlet of a sink, basin or other vessel. The locating member 10 locates the stopper-strainer device 1 in the drain outlet and the frame 8 seats on the edge of the drain outlet. Since the closure plate 4 seals with the diaphragm 2, fluid, located on the side 22 of the stopper-strainer device 1, is prevented by the closure plate 4 from flowing to the first side 12 of the stopper-strainer device 1. Accordingly, the fluid is retained within the sink, basin or vessel on the second side 22 of the stopper-strainer device 1.

To empty the sink, basin or vessel and strain, or filter, particulate material from the fluid as it drains from the sink, basin or vessel, the diaphragm 2 of the stopper-strainer device 1 is pushed in its central region in the direction of the arrow G shown in FIG. 2 such that the diaphragm 2 is everted to its condition shown in FIG. 4 whilst the stopper-strainer device 1 is in position over the drain outlet. In this condition of the diaphragm 2, the edge 20 of the closure plate 4 is out of contact with the diaphragm 2 and the retaining member 18 such that fluid is able to freely flow through the apertures 6 from the second side 22 to the first 12 of the stopper-strainer device 1. The diaphragm 2 restrains any material that is unable to pass through the apertures 6.

Once the sink, basin or vessel is drained, the particulate material restrained by the diaphragm 2 may be expelled as previously described herein.

In FIGS. 5 to 8, there is shown a second embodiment of a stopper-strainer device 30 in accordance with the present invention.

The stopper-strainer device 30 of the second embodiment differs from the stopper-strainer device 1 of the first embodiment in the arrangement of the closure means. In other respects, the stopper-strainer device 30 is similar to the stopper-strainer device 1. Accordingly, the same reference numerals are used in FIGS. 5 to 8 which illustrate the stopper-strainer device 30, as were used in FIGS. 1 to 4 which illustrate the stopper-strainer device 1. Accordingly, the following description of the stopper-strainer device 30 will be directed to the closure means of the stopper-strainer device 30, it being understood that the remaining parts of the stopper-strainer device 30 are similar to the corresponding parts of the stopper-strainer device 1 and function in similar manner to the corresponding parts of the stopper-strainer device 1.

In the stopper-strainer device 30, the closure means comprises gates 32. The gates 32 are cut from the diaphragm 2 but are still connected to the diaphragm 2. This forms the apertures 6.

In the first condition of the diaphragm 2 (shown in FIG. 6) the gates 32 are biased such that the edges 34 of the gates 32 seal with the diaphragm 2 at the edges 36 of the apertures 6. In this condition of the diaphragm 2, the stopper-strainer device 30 functions as a stopper.

Figure 6:
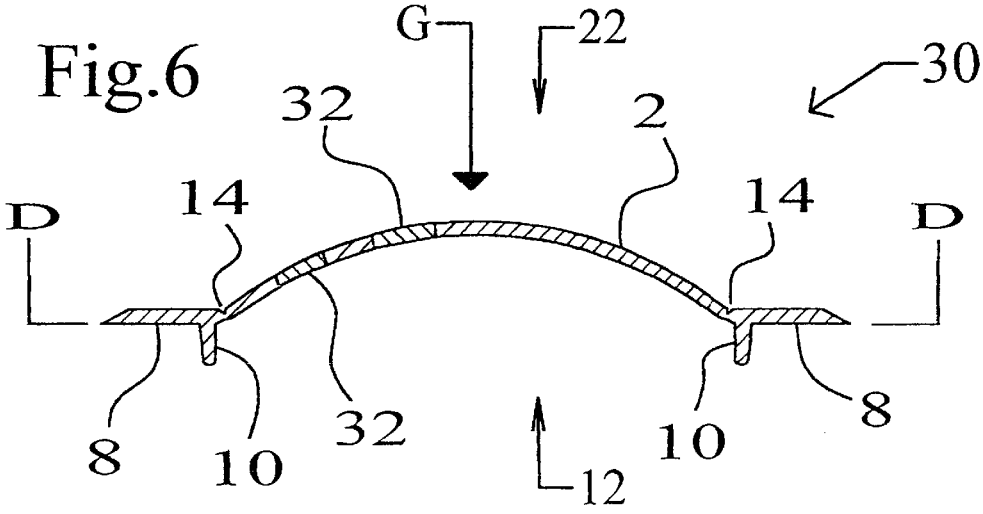
FIG. 6 is a cross-sectional view of the stopper-strainer device taken along the line D—D shown in FIG. 5.
Figure 7:
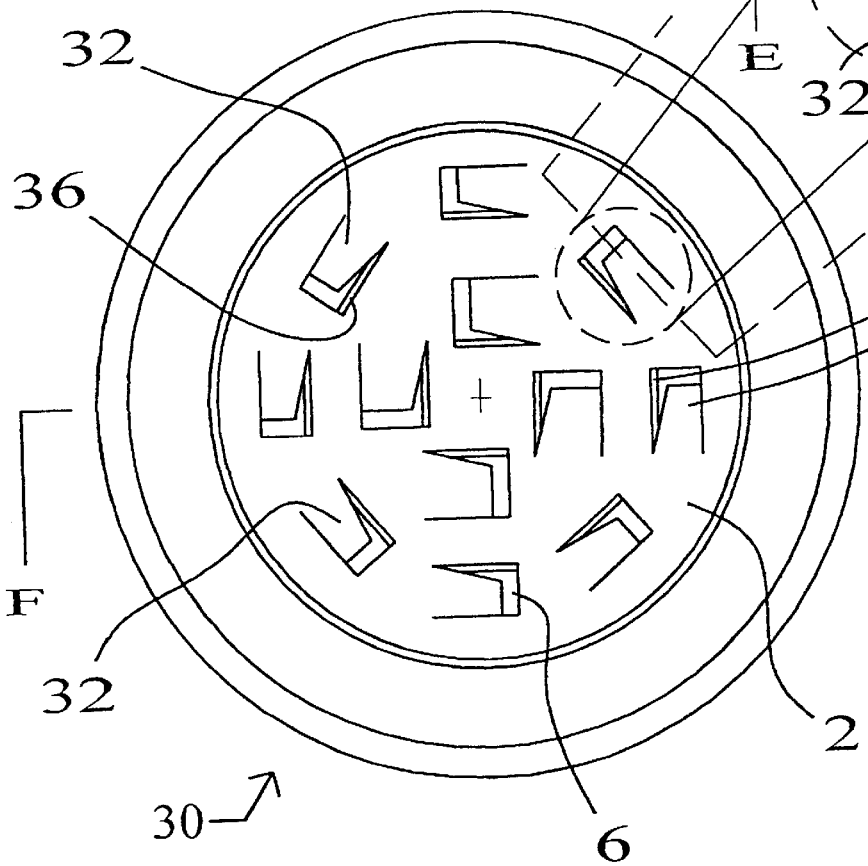
FIG. 7 is a bottom plan view of the stopper-strainer device shown in FIG. 5.
Figure 7A:
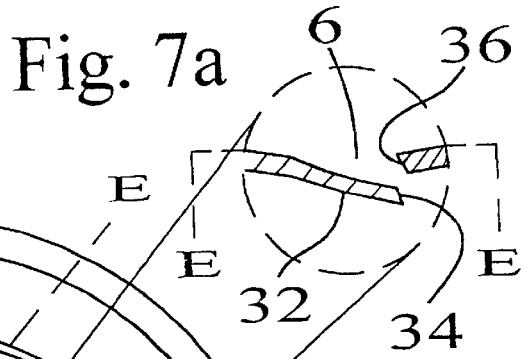
FIG. 7*a* is an enlarged view of a cross-section of a portion of the stopper-strainer device taken along the line E—E shown in FIG. 7.

When the diaphragm 2 is pushed in its middle region in the direction of arrow G, as shown in FIG. 6, the diaphragm 2 will be everted to the condition shown in FIG. 8 in a similar manner to that previously herein before described with reference to the stopper-strainer device 1 of the first embodiment. This results in the diaphragm 2 being placed in its second condition as shown in FIG. 8.

In the second condition of the stoper-strainer device 30, the edges 34 of the gates 32 are out of contact with the diaphragm 2 at the edges 36 of the apertures 6. This enables fluid to flow from the second side 22 of the stopper-strainer device 30 through the apertures 6 to the first side 12 of the stopper-strainer device 30.

The gates 32 extend away from the diaphragm 2 on the first side 12 of the stopper-strainer device 30 such that they are spaced from the diaphragm 2.

Figure 8:
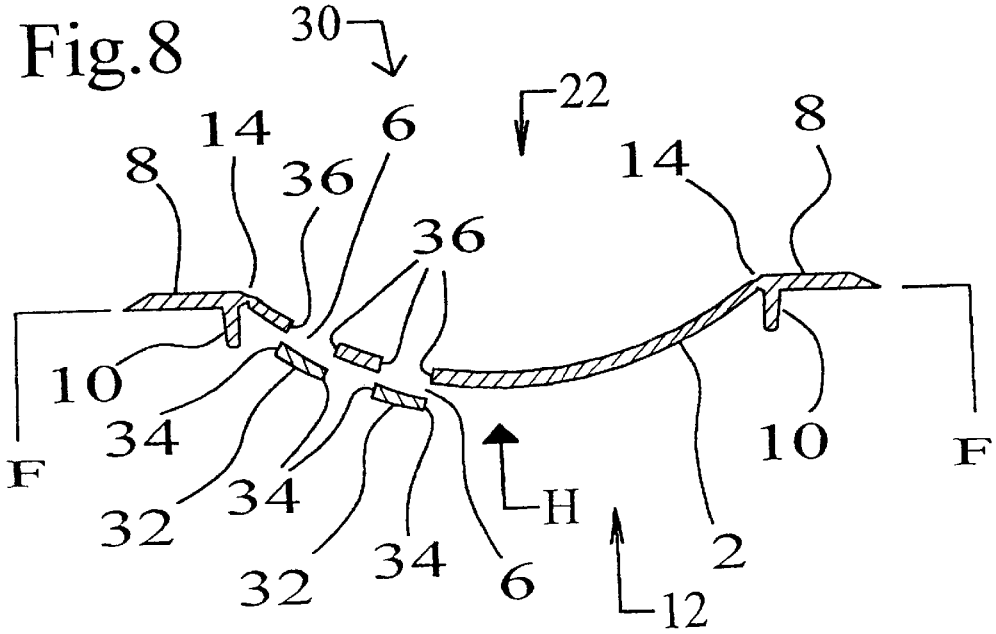
FIG. 8 is a cross-sectional view of the stopper-strainer device taken along the line F—F shown in FIG. 7.

The diaphragm 2 can be returned to the condition shown in FIG. 6 (where the stopper-strainer device 30 functions as a stopper) by pushing the diaphragm 2 in its mid region in the direction shown by arrow H in FIG. 8.

The stopper-strainer device 30 is able to function as a stopper or a strainer in similar manner to that previously herein before described with reference to the stopper-strainer device 1 of the first embodiment. Similarly, any particulate material restrained by the diaphragm 2 of the stopper-strainer device 30, when functioning as a strainer, can be expelled by everting the diaphragm 2 from its second condition shown in FIG. 8 to its first condition shown in FIG. 6.

Since the stopper-strainer device 30 has a continuous surface on the second side 22 thereof, any particulate material expelled from the diaphragm 2 does not contact any other part of the stopper-strainer device 30 which provides effective expulsion of any particulate material.

As an alternative to the provision of gates 32 to alternatively seal and open apertures 6 with eversion of the diaphragm 2, alternative embodiments of the present invention may provide a diaphragm having nodules or "duck bill" shaped members which project to the first side 12 of the stopper-strainer device which alternatively seal and open apertures 6.

Throughout this specification, unless the context requires otherwise, the word "comprise", or variations such as "comprises" or "comprising", will be understood to imply the inclusion of a stated integer or group of integers but not the exclusion of any other integer or group of integers.

Modifications and variations such as would be apparent to a skilled addressee are deemed to be within the scope of the present invention.

What is claimed is:

1. Stopper-strainer device comprising:

diaphragm means having apertures for passage of fluid and said diaphragm means is moveable between first and second conditions;

frame means provided at a periphery of said diaphragm means, said frame means arranged to sit adjacent an opening over which the stopper-strainer device may be placed; and closure means which is substantially flat in at least said second condition;

wherein in said first condition passage of fluid beyond said closure means is prevented such that, in use, said stopper-strainer device prevents passage of fluid therethrough; and in said second condition said closure means is spaced from said diaphragm means and, in use, fluid is able to pass through said apertures and beyond said closure means such that said stopper-strainer device allows passage of fluid therethrough while restraining material entrained in said fluid that is unable to pass through said apertures.

2. Stopper-strainer device according to claim 1, wherein locating means is provided to, in use, locate said stopper strainer device over the cross-section of a pipe or an entry thereto.

3. Stopper-strainer device according to claim 1, wherein said frame means and said diaphragm means are connected via connection means which allows said diaphragm means to move between said first and second conditions.

4. Stopper-strainer device according to claim 3, wherein said connection means is provided between said frame means and said diaphragm means and is thinner than said frame means and thinner than said diaphragm means.

5. Stopper-strainer device according to claim 1, wherein said closure means is retained with said diaphragm means by lug means.

6. Stopper-strainer device according to claim 5, wherein said lug means extends from said diaphragm means on a first side of said stopper-strainer device.

7. Stopper-strainer device according to claim 5, wherein said lug means spaces said closure means from said diaphragm means in said second condition of said diaphragm means.

8. Stopper-strainer device according to claim 1, wherein said closure means is provided with at least one edge and said edge seals with said diaphragm means in said first condition to thereby prevent passage of fluid beyond said closure means.

9. Stopper-strainer device according to claim 8, wherein said diaphragm means is provided with-retaining means to retain said closure means in sealing contact with said diaphragm means.

10. Stopper-strainer device according to claim 9, wherein said retaining means comprises a formation extending on a first side of said stopper-strainer device.

11. Stopper-strainer device according to claim 9, wherein said closure means comprises a plate and the edge of said plate engages with said retaining means of said diaphragm means.

12. Stopper-strainer device according to claim 11, wherein the edge of said plate is beveled to mate with the surface of said diaphragm means.

13. Stopper-strainer device according to claim 1, wherein said closure means is resiliently biased toward said diaphragm means in said first condition.

14. Stopper-strainer device according to claim 1, wherein said stopper-strainer device has a first side and a second side, the surface of said diaphragm means at said second side of said stopper-strainer device being substantially smooth and continuous except for said apertures and, in use, said material is restrained on said second side.

15. Stopper-strainer device according to claim 14, wherein in said first condition said diaphragm means projects beyond said frame means on said second side of said stopper-strainer device and in said second condition said diaphragm means projects beyond said frame means on said first side of said stopper-strainer device and, in use, pushing said diaphragm means from said second condition to said first condition expels said material restrained by said stopper-strainer device.

16. Stopper-strainer device according to claim 1, wherein said diaphragm means is substantially resilient and flexible.

* * * * *